US005113915A

United States Patent [19]

Ritter et al.

[11] Patent Number: 5,113,915

[45] Date of Patent: May 19, 1992

[54] GRID WELDING MACHINE

[75] Inventors: Gerhard Ritter; Klaus Ritter; Gerhard Schmidt, all of Graz; Walter Resch, Pichling Nr., all of Austria

[73] Assignee: EVG Entwicklungs-u.Verwertungs-Gesellschaft m.b.H., Graz, Austria

[21] Appl. No.: 613,818

[22] PCT Filed: May 23, 1990

[86] PCT No.: PCT/AT90/00049

§ 371 Date: Jan. 10, 1991

§ 102(e) Date: Jan. 10, 1991

[87] PCT Pub. No.: WO90/14181

PCT Pub. Date: Nov. 29, 1990

[30] Foreign Application Priority Data

May 24, 1989 [AT] Austria ..... 1269/89

[51] Int. Cl.[5] ..... B21F 27/10

[52] U.S. Cl. ..... 140/112

[58] Field of Search ..... 140/112; 219/56

[56] References Cited

U.S. PATENT DOCUMENTS 2,368,047 1/1945 Southwick ..... 140/112
3,961,153 6/1976 Smith et al. .
4,468,550 8/1984 Gött et al. .

FOREIGN PATENT DOCUMENTS 267293 12/1968 Austria .
373799 2/1984 Austria .
37392 10/1981 European Pat. Off. ..... 140/112
204606 11/1908 Fed. Rep. of Germany .
1565526 2/1970 Fed. Rep. of Germany .
1552137 11/1971 Fed. Rep. of Germany .
1363967 5/1964 France .

*Primary Examiner*—Lowell A. Larson
*Attorney, Agent, or Firm*—Frishauf, Holtz, Goodman & Woodward

[57] ABSTRACT

A welding machine for manufacturing wire nets from mutually perpendicular longitudinal and transverse wires welded at the points of intersection comprises a device for feeding the longitudinal wires in a horizontal welding plane, two devices for simultaneously inserting two transverse wires (Q,Q'), arranged at equal distances on either side of insertion lines (K,K'), a welding electrode arrangement for carrying out two-point welding in the direction of the longitudinal wires, and two feeder arms (8,9) for transferring the transverse wires from the insertion lines to the welding lines (S, S'). The feeder arms are fitted with clamping devices (11,12) for the transverse wires and can be moved together back and forth between the insertion lines and the welding lines along predetermined tracks (U, U'; O, O'). At least one of the feeder arms can be moved by means of a mechanical drive (22) in order to prestress both transverse wires relative to the other feeder arm in the direction of the transverse wires, and the transverse wires are positioned precisely in accordance with the predetermined distribution of the transverse wires by means of pivotable positioning elements (17,17') provided in the region of the welding lines.

13 Claims, 3 Drawing Sheets

IIa
IIa
23
2
24
11
$P_2$
Q
$P_8$
25
$P_g$
12
26
$P_{10}$

23'
8
IIb
23
S'
Q'
30
24'
27
IIb
Pg
24
a
Q'
Q
U'
U
Q
S
$P_{10}$
K'
Q
2
K

GRID WELDING MACHINE

FIELD OF THE INVENTION

The invention relates to a welding machine for manufacturing grids from longitudinal and transverse wires intersecting one another at right angles and welded at the intersections, having a device for delivering the longitudinal wires in a horizontal welding plane, two mutually spaced apart devices, disposed on feed lines, for simultaneous feeding or injection of two transverse wires, a welding electrode arrangement for performing double spot welding in the direction of the longitudinal wires, and two feeder arms for transferring the transverse wires from the feed lines to the welding lines; the feeder arms are disposed outside the outer longitudinal wires and are movable back and forth on predetermined paths of motion between the feed lines and the welding lines, by means of a common feeder arm holder extending at right angles to the longitudinal wire direction.

In a grid welding machine known from Austrian Patent 267.293, two transverse wires are simultaneously delivered to two feed lines disposed at a fixed distance from one another, pushed forward to the welding lines by means of transverse wire feeders, and there welded to the longitudinal wires with the aid of double spot welding electrodes. One disadvantage of this known grid welding machine is that only grids having a single predetermined, invariable transverse wire spacing, which is equivalent to the mutual spacing of the transverse wire feed lines, can be produced.

In a grid welding machine of the type described initially above and known from Austrian Patent 373.799, this disadvantage is overcome; here the positionally fixed feed lines of the two transverse wires are disposed at a fixed mutual spacing, while contrarily the two welding lines are of variable position. The transfer of the transverse wires from the feed lines to the welding lines is effected with a separate feeder for each transverse wire, and the feeders are mounted on a common holder. The transverse wire feeders can be disposed both between the longitudinal wires, in other words within welding range, and outside welding range. In this known machine, however, triggering the transverse wire feeders entails considerable expense and is often superfluous, because in most applications standard grids with transverse wire spacings that amount to a multiple of a predetermined minimum basic spacing are produced. Both of the above-described known grid welding machines also have the disadvantage that the transverse wires rest with variably good alignment loosely in recesses of the transverse wire feeder apparatuses. Especially with close-meshed grids with a small transverse wire spacing and small transverse and longitudinal wire diameters, this results in an asymmetrically structured finished grid web.

Although it is known from Soviet Union Patent 837.668 to clamp a transverse wire during its delivery to the welding line, nevertheless the clamping force is not adjustable but instead depends on the structurally dictated increase in spacing between the clamping jaws during the delivery movement and on the spring constants of any relief springs that may be provided.

THE INVENTION

The object of the invention is to create a grid welding machine of the generic type described at the outset above that makes it possible, while exploiting the advantages of double spot welding, to produce grids the transverse wire spacing of which is equivalent to a predetermined minimum basic spacing or a multiple of this basic spacing of the transverse wires, in a structurally simple and operationally reliable way. Briefly, the welding machine according to the invention is distinguished by the fact that the feeder arms are embodied for receiving both transverse wires jointly and are equipped with clamping devices for the transverse wires; that at least one of the feeder arms, for joint prestressing of both transverse wires, is movable relative to the other feeder arm in the transverse wire direction by means of a mechanical drive mechanism with adjustable clamping force; and that positioning devices pivotable in the range of the welding lines are provided for exact positioning of the transverse wires in accordance with the predetermined transverse wire spacing.

Because both transverse wires are clamped simultaneously prior to being welded to the longitudinal wires, with a clamping force that can be adjusted to the transverse wire material, the irregularities in the transverse wires dictated by the alignment processes are advantageously compensated for, and production-dictated asymmetries in the finished grid, which for instance also occur from thermal expansions during the welding, are avoided. The positioning devices assure that the exact transverse wire spacing is adhered to, and also effect a damping of the vibrations arising in the transverse wires as they are transferred. According to the invention, grids with transverse wire spacings that are each a multiple of a predetermined minimum basic spacing, and in particular close-meshed grids, can be manufactured with high accuracy.

It should be noted that from Examined German Applications 1.552.137 and 1.566.526, for welding machines of a different kind, it is known to embody the feeder arms for receiving both transverse wires jointly.

In a preferred embodiment of the invention, at least one of the feeder arms is disposed on the feeder arm holder such that it is displaceable relative to the other feeder arm, for positioning. This makes it possible to adjust the machine to different grid widths. Preferably, the paths of motion of the feeder arms for the transverse wires from the feed lines to the welding lines, and the paths of motion for the return movement are each composed of one forward feed segment and one rocking motion segment.

In another characteristic of the invention, the welding machine is distinguished by the fact that the clamping devices for the transverse wires have lower clamping jaws that are openable and closable and cooperate with associated upper clamping jaws; the upper clamping jaws are each provided with a plurality of detent recesses for receiving the transverse wires, and the mutual spacing between these recesses is equivalent to the predetermined minimum transverse wire spacing. In this way, the transverse wires are held perfectly firm for the clamping process and for transfer. Grids can also be produced in which the spacing of the transverse wires amounts to a multiple of a minimum possible basic spacing of the transverse wires.

A further feature of the invention has the characteristics that the upper clamping jaw of the clamping device on the feed side forms a cutting tool, and that at least two transverse wire feeds are provided in a nozzle block on the feed side, the outlet side of which block has a cutting edge for cooperation with the upper clamping jaw, forming the cutting tool, of the clamping device toward the feed, in order to sever the transverse wires from the wire stock.

According to the invention, the feeder arm remote from the delivery side is preferably pivotable in the transverse wire direction by the mechanical drive mechanism, which preferably has a clamping lever that is actuatable by means of a hydraulic cylinder that can be acted upon by adjustable pressure.

DRAWINGS

Further characteristics of the invention are described in detail below in an exemplary embodiment of the invention, referred to the drawings. Shown are:

FIG. 1, a perspective, schematic view of the essential elements of a welding machine according to the invention;

FIG. *2a*, schematically, the pickup and transfer positions and the paths of motion of the clamping devices for the transverse wires, seen in the direction of the arrows II*a*—II*a* of FIG. *2b;*

FIG. *2b*, a detail section taken through the clamping devices along the line II*b*—II*b* of FIG. *2a;* and FIGS. *3a* and *3b*, the dispositions of the welding electrodes and possible welding positions of the transverse wires in the welding machine according to the invention.

DETAILED DESCRIPTION

Figure 1:
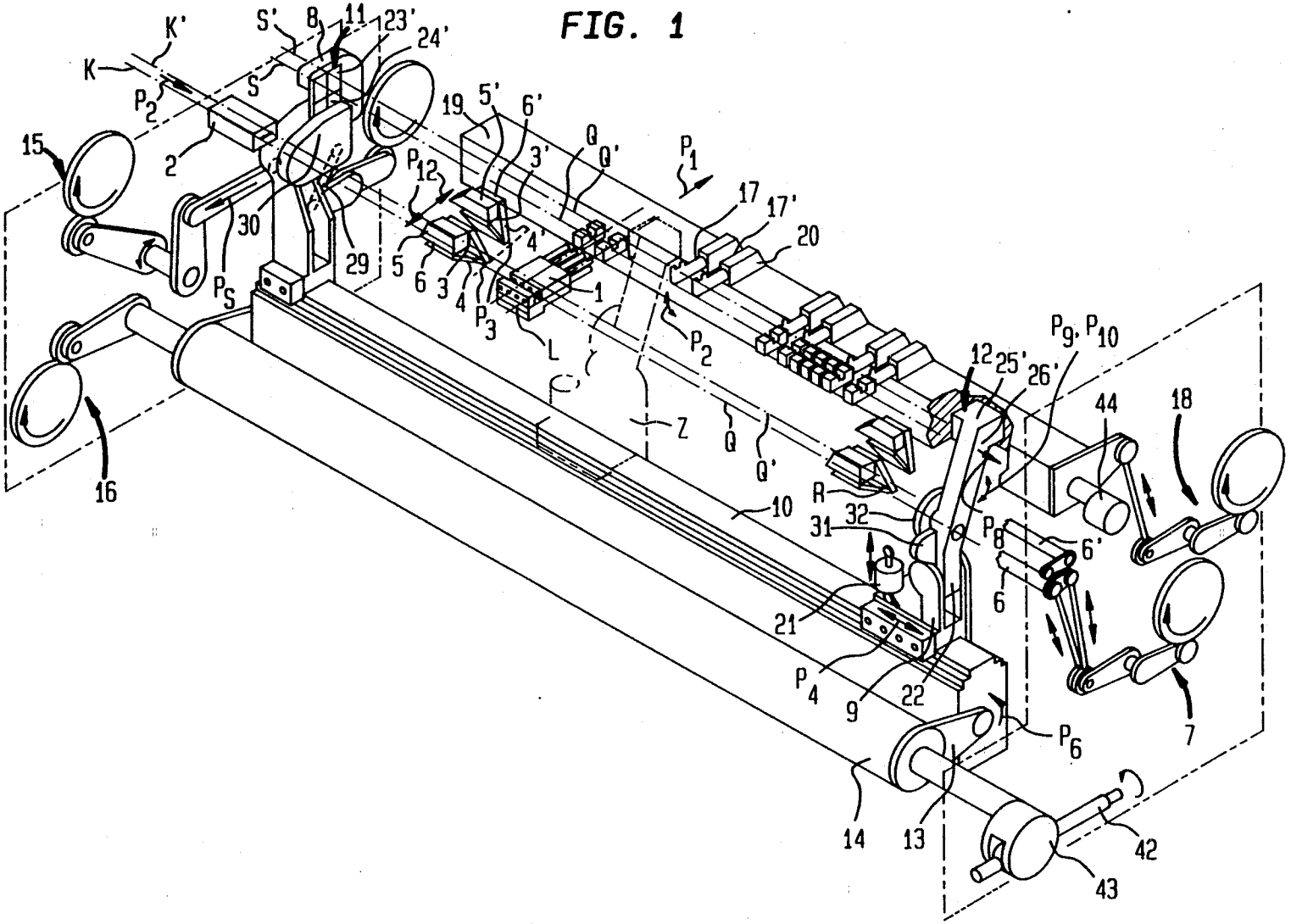

In the grid welding machine shown in FIG. 1, two transverse wires Q, Q' are welded simultaneously in two welding lines S, S' with longitudinal wires L pushed toward them in the production direction $P_1$ to make a grid web. The finished grid web is pulled out of the welding lines by means of feed rollers, not shown. The longitudinal wires L are delivered to the welding lines S, S' via a plurality of guide blocks 1 disposed side by side, only one of which is shown in FIG. 1. Each guide block 1 has substantially a plurality of introduction nozzles side by side, which suitably comprise wear-resistant material and are equipped with longitudinal wires L in accordance with the desired longitudinal wire spacing. For each introduction nozzle, each guide block 1 also has a lower and upper guide prism, preferably V-shaped, following the guide nozzle; the guide prisms are each pressed against the longitudinal wires by means of a spring steel sheet, to assure exact guidance of the longitudinal wires L. The guide blocks 1 are disposed on a rail (not shown) such that they are adjustable transversely to the production direction $P_1$.

From supply coils, not shown, and by means of feed and alignment devices, two transverse wires Q, Q' at a time are simultaneously introduced, via a nozzle block 2 provided with a plurality of feed nozzles, into two feed or insertion lines K, K' in the direction of the arrow $P_2$ at right angles to the production direction $P_1$ at a selectable mutual spacing corresponding to the desired transverse wire spacing in the finished grid. Each feed line K and K' is defined by recesses, which are formed between a plurality of rigid plates 3, 3' located transversely to the group of longitudinal wires and a plurality of pivotable flaps 4, 4' located exactly opposite the plates. The recesses are merely roughly adapted to the transverse wire diameter; only the recess R located farthest away from the nozzle block 2 is provided with a centering piece adapted accurately to the transverse wire diameter, for the sake of accurate fixation of the transverse wires Q, Q'. With their upper end, the plates 3, 3' are secured to a plate holder 5, 5' extending across the width of the machine. The flaps 4, 4' are supported by their upper end each against a flap shaft 6 and 6', respectively, which also extend across the width of the machine and are pivotable as indicated by the double arrow $P_3$. The pivoting motion of the flap shafts 6, 6' is effected by means of a swivel apparatus 7 formed by a cam plate and rocking levers. As a result, the feed lines K, K' are freed for the transfer, to be described below, of the transverse wires Q, Q' into the welding lines S, S'.

The feed nozzles in the nozzle block 2 have a mutual spacing equivalent to the minimum possible basic spacing a of the transverse wires in the grid to be produced, and are also adapted in their dimensions to the diameter of the transverse wire to be processed. The amount of the minimum possible basic spacing a depends above all on the type of grid to be produced, for instance whether its spacing is based on inches or is metric.

The transfer of the transverse wires Q, Q' from the feed lines K, K' into the welding lines S, S' is effected by means of two pivotable feeder arms 8, 9, each of which is disposed on the machine frame on the outer side edge of the grid web to be produced. The two feeder arms 8, 9 are secured to a common holder 10. The feeder arm 9 remote from the feed side is displaceable on the holder 10 t right angles to the production direction $P_1$ as indicated by the double arrow $P_4$, so that it can assume any intermediate position Z indicated by dashed lines that makes it possible to produce grid webs with a selectable width, in other words with a selectable transverse wire length.

The feeder arm 8 on the feed side is provided with a clamping device 11, which in the pickup position defined by the feed lines K, K' is precisely aligned with the feed nozzles of the nozzle block 2 and embodied such that it can firmly clamp the transverse wires Q, Q' and at the same time, as will be explained below, sever them from the wire stock. The other feeder arm 9 is provided with a clamping device 12, which is capable of firmly clamping the transverse wires Q, Q'.

Figure 2B:
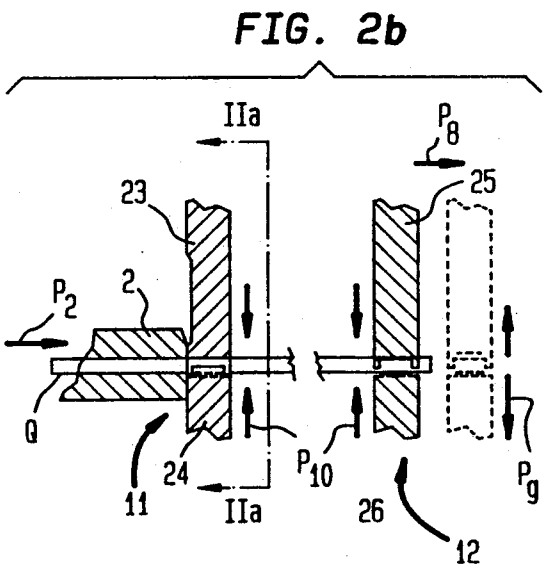
Figure 2A:
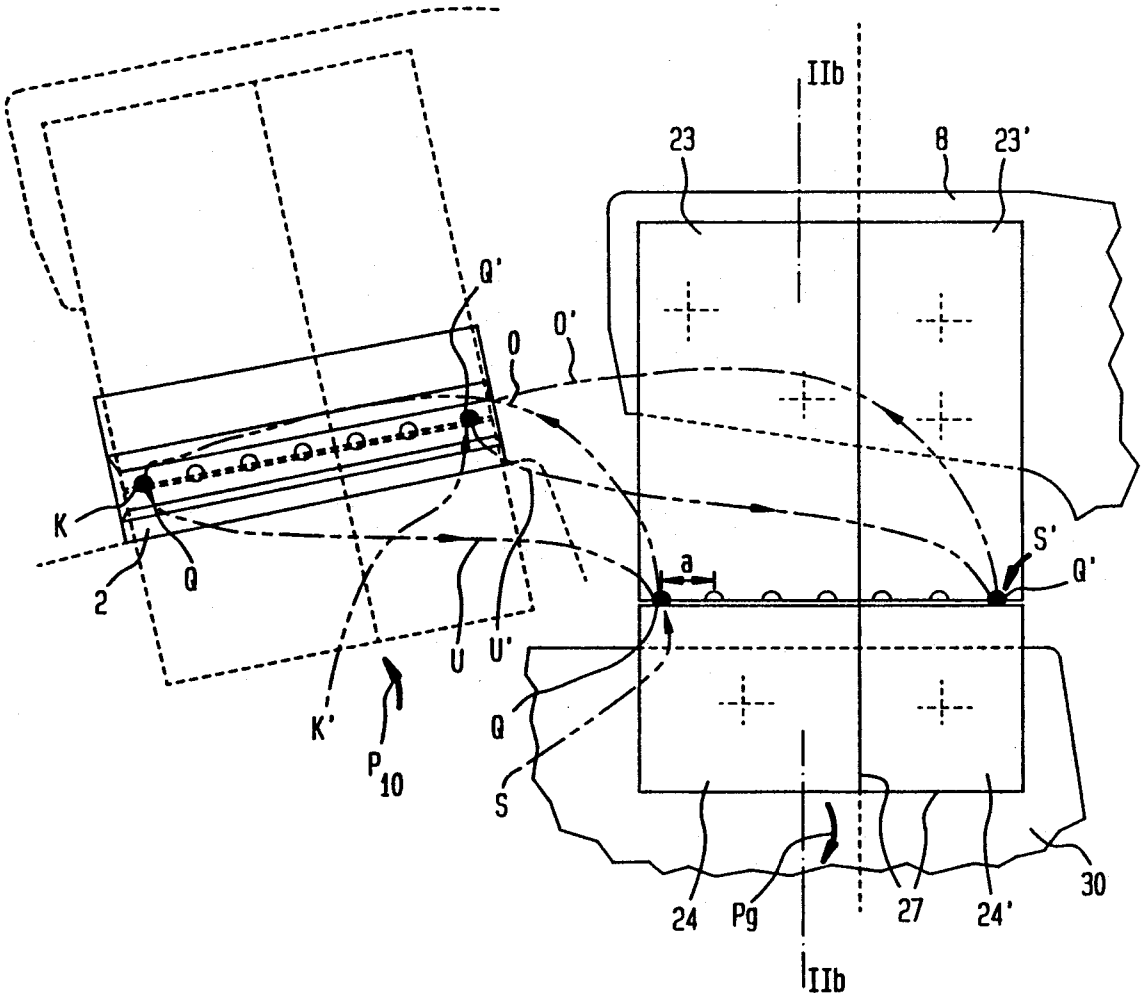

Once the transverse wires Q, Q' have been firmly clamped, the clamping devices 11, 12 move along the paths of motion shown in FIG. 2 in the direction of the arrows U, U', in order to sever the transverse wires Q, Q' from the wire stock and transfer them from the pickup positions K, K' to the welding lines S, S'. Once the welding of the transverse wires to the longitudinal wires has been completed, the clamping devices 11, 12, with the aid of the feeder arms 8, 9, execute the motions shown in FIG. 2 in the direction of the arrows 0, 0', in order to move out of the welding lines S, S' into the pickup positions K, K' and pick up the transverse wires Q, Q' that are ready in the feed lines K, K'.

The motions O, O' and U, U' are composed of two coupled individual motions of the feeder arms 8, 9, specifically a substantially linear feeding or pushing motion corresponding to the double arrow $P_5$ and a rocking motion corresponding to the double arrow $P_6$.

The holder 10 is pivotably supported at one end of a rocking lever 13 that is connected rigidly to a rocking shaft 14 at its other end. The feeding motion corresponding to the double arrow $P_5$ is executed by a pushing device 15 comprising a cam plate and a rocking lever. The rocking lever 13 can be made to execute a rocking motion indicated by the double arrow $P_6$ by means of a rocking device 16 comprising a cam plate and a rocking lever.

In order to adhere to an exact transverse wire spacing, the transverse wires Q, Q' are precisely positioned in the welding lines S, S' by means of arms 17, 17' forming positioning devices, which project from a beam 19 that is pivotable as indicated by the double arrow $P_7$ by means of a swivel drive mechanism 18 and which are provided on their free ends with detent recesses for the transverse wires. During the pickup of the transverse wires Q, Q' and during the welding process, the positioning arms 17, 17' assume an upper working position. The positioning arms 17, 17' also have the task of damping the vibrations arising during the transfer motion along the paths of motion U, U' in the transverse wires Q, Q' and to eliminate them completely prior to the welding process. The detent recesses of the positioning arms 17, 17' have a mutual spacing that advantageously matches the minimum possible basic spacing a of the transverse wires. The positioning arms 17, 17' can be adjusted in the production direction $P_1$ by means of an adjuster 20, in order to be adapted precisely to the particular transverse wire spacing.

After the fixation by means of the clamping device 11, 12 explained above, the transverse wires Q, Q', during the feed motion along the paths of motion U, U', are tightened with the aid of a clamping lever 22 that is actuatable by a clamping cylinder 21 and pivotably supported in the feeder arm 9 and that pivots the clamping device 12 outward in the transverse wire direction or in the direction of the arrow $P_8$, in order to eliminate any unevenness or wavyness in the transverse wires. The prestressing of the transverse wires also avoids asymmetry in the finished grid web resulting from thermal strains during welding. The stressing force is adjusted in accordance with the particular strength figures for the transverse wires. If a hydraulic cylinder is used as the tightening cylinder 21, this is done for instance by suitable triggering of the hydraulic pressure.

As FIG. 2 shows, the clamping device 11 comprises an upper clamping jaw 23, 23' and a lower clamping jaw 24, 24'. The upper clamping jaw 23, 23' has a cutting edge on its side toward the nozzle block 2 that makes it possible, in cooperation with a cutting edge on the trailing side of the nozzle block 2, to sever the transverse wires Q, Q' from the wire stock during the feed motion of the arms 8, 9. The clamping device 12 of the feeder arm 9 comprises an upper clamping jaw 25, 25' and a lower clamping jaw 26, 26'. Each of the upper clamping jaws 23, 23' and 25, 25' have a plurality of recesses, which are adapted in their dimensions to the diameter of the transverse wire and which in their lateral spacing each correspond to the minimum possible basic spacing a of the transverse wires.

The lower clamping jaws 24, 24'; 26, 26' have teeth or milled edges extending transversely to the feed direction $P_2$, in order to increase the frictional engagement between the clamping jaws and the transverse wires Q, Q'.

Shunting in the welding of the two transverse wires Q, Q' to the longitudinal wires L, the clamping jaws each comprise one part 23', 24', 25', 26' that is toward the front in the feeding direction of the longitudinal wire and a rear part 23, 24, 25, 26, each of which receive only one transverse wire and are insulated electrically from one another by an insulator 27 and are additionally insulated from the mounts of the clamping jaws in the feeder arms 8, 9.

After one welding operation has ended, the transverse wire feeding proceeds as follows: the clamping device 11 is opened, in that the lower clamping jaw parts 24, 24' are first lowered in the direction of the arrow $P_9$ with the aid of a clamping lever 30 actuated by a clamp drive mechanism 28 and a clamping cylinder 29. At the same time, the clamping device 12 is opened by lowering the lower clamping jaw parts 26, 26' in the direction of the arrow $P_9$ with the aid of a clamping lever 32 actuated by a clamping cylinder 31. When the clamping jaws 25, 26 are opened, the clamping lever 22 completes its motion in the direction of the arrow $P_8$ and moves the clamping jaws 25, 26 into the terminal position shown in dashed lines in FIG. 2. Next the clamping devices 11, 12 are jointly transferred to the pickup positions K, K'. In this process the upper clamping jaws move along the paths of motion O, O' shown in FIG. 2, while the lower clamping jaws are guided along paths of motion that are substantially parallel to the paths of motion O, O' but for the sake of simplicity are not shown in FIG. 2.

Once the pickup positions K, K' have been reached, the clamping devices 11, 12 are closed, in order to securely clamp the transverse wires Q, Q'. The closing motion in the direction of the arrow $P_{10}$ is effected by the lower clamping jaws 24, 24' and 26, 26', is performed with the aid of the clamping lever 30, actuated by the clamp drive mechanism 28 and the clamping cylinder 29, and with the aid of the clamping lever 32 actuated by the clamping cylinder 31.

As shown in FIG. *3a*, the welding current is supplied by transformers and bus bars, not shown, by means of a current feed 33 of a top electrode 34 that is at the rear in the production direction $P_1$, and flows first via the rear weld point, formed by the longitudinal wire L and the rear transverse wire Q, into a rear bottom electrode 35, and from there flows either directly (FIG. *3b*) or via electrically conducting electrode separators 36, 36' (FIG. *3a*) into the front bottom electrode 35', and then via the front welding point, formed by the longitudinal wire L and the front transverse wire Q', into a front top electrode 34', and then via a current feed 33' is diverted to suitable bus bars.

The bottom electrodes 35, 35', and the electrode separators 36, 36' are mounted removably in a lower electrode mount 37. The two top electrodes 34, 34' are electrically separated by an insulator 38. During the welding process, the bottom electrodes 35, 35' are stationary, while the top and electrodes 34, 34' are movable with the aid of an electrode beam 39 as indicated by the double arrow $P_{11}$ and can thus be acted upon by the necessary welding pressure. The top electrodes 34, 34' can be adapted individually in terms of their welding pressure to the dimensions of the longitudinal and transverse wires to be welded, by means of an adjusting screw 40 and an electrode spring 41.

In FIGS. *3a* and *3b*, possible welding positions A–G for the transverse wires Q, Q' are schematically shown, each of which is equivalent to a multiple of a minimum possible basic spacing a. When grid webs having the minimum possible basic spacing a are produced, the welding positions A-B are assumed. Then a somewhat modified front top electrode 34' having a recess shown in dot-dash lines is used, in order to avoid re-welding of the already welded transverse wire Q' located in position D. If a transverse wire spacing having twice the value of the basic spacing a is desired, then either the welding positions A—D or C—B can be assumed. The welding position C—D is equivalent to three times the basic spacing a.

Figure 3B:
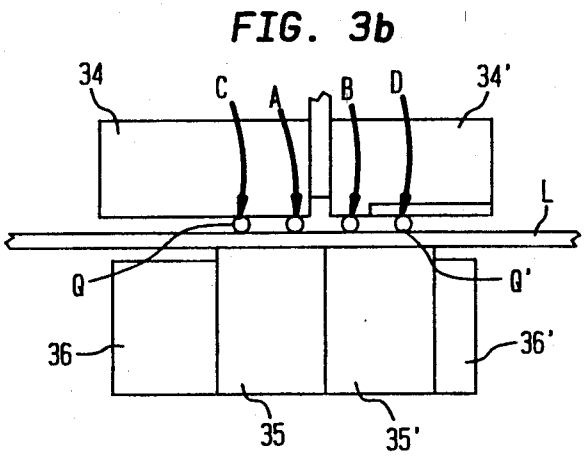
Figure 3A:
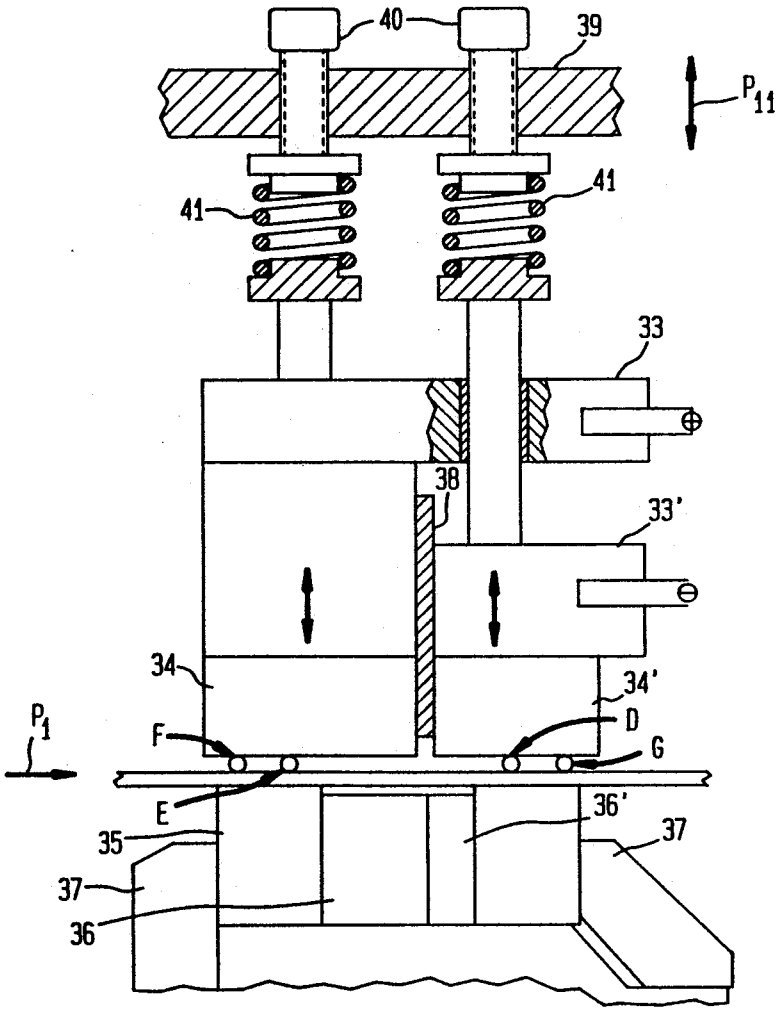

In the welding positions described above, the two bottom electrodes 35, 35' are disposed adjacent one another, as shown in FIG. 3b. The welding positions E—D define four times the minimum possible basic spacing a. If five times the basic spacing a is desired, then the welding positions F—D or E—G can be assumed. The welding position F—G allows a transverse wire spacing having six times the basic spacing a. As shown in FIG. 3a, in the lastnamed welding positions the bottom electrodes 35, 35' are separated by the electrode separators 36, 36'.

To achieve exact orthogonality between the transverse wires Q, Q' and the longitudinal wires L, the rocking shaft 14 can be adjusted unilaterally in the production direction $P_1$ by means of an eccentric adjustment 43 that can be positioned via an adjusting spindle 42. The positioning beam 19 can also be adjusted to exact orthogonality of the transverse wires Q, Q' relative to the longitudinal wires L, with the aid of an adjusting eccentric 44.

When the transverse wire spacing is changed to a multiple of the minimum possible basic spacing a, wires are supplied to the corresponding feed nozzles of the nozzle block 2, and the plate holders 5, 5' and the flap shafts 6, 6' are adjusted (according) to the double arrow $P_{12}$. At the same time, and as shown in FIGS. 3a and 3b, the bottom electrodes 35, 35' and the electrode spacers 36, 36' can optionally change positions with one another. If the minimum basic spacing a is to be fundamentally changed, for instance from a one-inch basic spacing to a 20-mm basic spacing, then the nozzle block 2, clamping device 11, clamping device 12 and positioning arms 17, 17' will all be replaced completely.

It is understood that the exemplary embodiment described can be modified in various ways within the scope of the concept of the invention.

I claim:

1. A welding machine for manufacturing grids from longitudinal and transverse wires (Q, Q') intersecting one another at right angles and welded together at the intersection points, having a device for delivering a plurality of longitudinal wires in a horizontal welding plane;

two feed devices, located on respective feed lines, mutually spaced-apart from each other, for simultaneous feeding of two transverse wires;

a welding electrode arrangement for performing double spot welding in the direction of the longitudinal wires and defining a plurality of welding lines distributed over a range;

two feeder arms (8, 9) for transferring the transverse wires from the feed lines to the welding lines; and a common feeder arm holder extending at right angles to the longitudinal wire direction;

the feeder arms being located on said common feeder arm holder, movable thereby, disposed outside the outermost longitudinal wires and being movable back and forth on predetermined paths of motion between the feed lines and the welding lines, characterized in that the feeder arms (8, 9) are formed for receiving both transverse wires (Q, Q') jointly;

are equipped with clamping devices (11, 12) which are provided on said feeder arms for the transverse wires (Q, Q');

at least one of the feeder arms (8, 9) is movable relative to the other feeder arm in the transverse wire direction for joint prestressing of both transverse wires (Q, Q');

a mechanical drive mechanism (22) with adjustable stressing force is provided, coupled to said at least one feeder arm; and positioning devices (17, 17') are provided pivotable in the range of the welding lines (S, S') for exact positioning of the transverse wires (Q, Q') in accordance with a predetermined transverse wire spacing.

2. The welding machine of claim 1, characterized in that for positioning, at least one (9) of the feeder arms is disposed displaceably on the feeder arm holder (10) relative to the other feeder arm (8).

3. The welding machine of claim 1, characterized in that the positioning devices are formed by arms (17, 17') offstanding from a pivot shaft (19) extending across the width of the machine, the arms being provided in the region of their free ends with detent recesses for the transverse wires.

4. The welding machine of claim 1, characterized in that the paths of motion (U, U') of the feeder arms (8, 9) for the transverse wires (Q, Q') comprises a path from the feed lines (K, K') to the welding lines (S, S') and paths (O, O') from the feed lines and forming return motion paths;

and wherein said paths each comprise one forward feed path segment ($P_5$) and one rocking motion path segment ($P_6$).

5. The welding machine of claim 1, characterized in that the clamping devices (11, 12) for the transverse wires (Q, Q') have openable and closable lower clamping jaws (24, 24'; 26, 26'), which cooperate with associated upper clamping jaws (23, 23'; 25, 25'), and that the upper clamping jaws (23, 23'; 25, 25') are each provided with a plurality of detent recesses for receiving the transverse wires, the mutual spacing of the recesses being equivalent to the predetermined minimum transverse wire spacing (a).

6. The welding machine of claim 5, characterized in that the upper clamping jaw (23, 23') of that one (11) of the clamping devices (11, 12) located toward the feed side forms a cutting tool, and that at least two transverse wire feeds are provided in a nozzle block (2) toward the feed side, the outlet side of which has a cutting edge for cooperation with the upper clamping jaw (23, 23') of the clamping device (11) on the feed side forming the cutting tool, in order to sever the transverse wires (Q, Q') from the wire stock.

7. The welding machine of claim 6, characterized in that the lower clamping jaw (24, 24') of that one (11) of the clamping devices (11, 12) located toward the feed side is actuatable by a clamping lever (30) that can be acted upon by means of a clamping cylinder (29) and a clamp drive mechanism (28), and that the lower clamping jaw (26, 26') of the clamping device (12) remote from the feed side is actuatable relative to the associated upper clamping jaw (25, 25') by a clamping lever (32) actuatable by means of a clamping cylinder (31).

8. The welding machine of claim 5, characterized in that the clamping jaws (23, 23'; 24, 24'; 25, 25'; 26, 26') of the clamping devices (11, 12) each comprise one part (23', 24'; 25', 26') to the front in the longitudinal wire feeding direction ($P_1$) and one rear part (23, 24, 25, 26) which are separated from one another by an insulator (27).

9. The welding machine of claim 6, characterized in that the mutual spacings of the wire feeds in the nozzle block (2) and the mutual spacings of the detent recesses in the positioning devices (17, 17') and in the upper clamping jaws (23, 23'; 25, 25') are equivalent to the minimum possible basic spacing (a) of the transverse wires.

10. The welding machine of claim 1, characterized in that the feeder arm (9) remote from the feed side is pivotable by the mechanical drive mechanism (22) in the transverse wire direction (Q, Q'), and the mechanical drive mechanism optionally has a clamping lever (22), which is actuatable by a hydraulic cylinder (21) that can be acted upon with adjustable pressure.

11. The welding machine of claim 1, characterized in that the welding electrode arrangement includes a top and a bottom electrode means;

and the bottom electrode means (35, 35') can be repositioned for various welding positions (A–G) of the welding lines (S, S') (FIGS. 3*a*, 3*b*).

12. The welding machine of claim 1, characterized in that the welding electrode arrangement includes a top and a bottom electrode means;

and the top electrode means (34, 34') can be individually positioned by means of an adjusting screw (40) and an associated electrode spring (41).

13. The welding machine of claim 1, characterized in that the feed lines (K, K') are each defined by at least one stationary plate (3, 3') and one pivotable flap (4, 4'), which between them define a transverse wire guide (R).

* * * * *